US005560421A

United States Patent [19]

Tanaka et al.

[11] Patent Number: 5,560,421

[45] Date of Patent: Oct. 1, 1996

[54] TWIN DRUM TYPE CONTINUOUS CASTING APPARATUS AND METHOD

[75] Inventors: Kisaburo Tanaka; Keiichi Yamamoto; Hideaki Takatani; Takashi Yamane; Takahiro Matsumoto; Ritsuo Hashimoto; Youichi Wakiyama, all of Hiroshima, Japan

[73] Assignee: Mitsubishi Jukogyo Kabushiki Kaisha, Tokyo, Japan

[21] Appl. No.: 377,053

[22] Filed: Jan. 23, 1995

[30] Foreign Application Priority Data

Jan. 24, 1994 [JP] Japan ..... 6-005688

[51] Int. Cl.[6] ..... B22D 11/06

[52] U.S. Cl. ..... 164/480; 164/428; 164/448

[58] Field of Search ..... 164/428, 480, 164/448

[56] References Cited

FOREIGN PATENT DOCUMENTS

| | | | |
|---|---|---|---|
| 0371177 | 6/1990 | European Pat. Off. . | |
| 0407978 | 1/1991 | European Pat. Off. . | |
| 3012736 | 6/1981 | Germany | 164/448 |
| 931416 | 5/1993 | Germany . | |

OTHER PUBLICATIONS

Patent Abstracts of Japan, vol. 14, No. 315 (M–0995) Jul. 6, 1990.

Patents Abstracts of Japan, vol. 18, No. 62 (M–1553), Feb. 2, 1994.

Patent Abstracts of Japan, vol. 8, No. 128 (M–302)[1565], Jun. 14, 1984.

Patent Abstracts of Japan, vol. 13, No. 425 (M–873) [3773], Sep. 21, 1989.

*Primary Examiner*—Kuang Y. Lin

*Attorney, Agent, or Firm*—Wenderoth, Lind & Ponack

[57] ABSTRACT

A twin drum type continuous casting apparatus is provided for continuously feeding molten metal into a cast portion defined by a pair of water cooling drums that are rotated in opposite directions to each other, thereby continuously casting a plate-like cast piece. A thin portion is formed close to an outer circumferential portion of each of opposite end portions, in a width direction, of each of the water cooling drums. A thin annular member having a hot water flow passage therein is formed in between the thin portion and a shaft with a space relative to an end face of each of the water cooling drums.

9 Claims, 7 Drawing Sheets

TWIN DRUM TYPE CONTINUOUS CASTING APPARATUS AND METHOD

BACKGROUND OF THE INVENTION

1. Field of the Industrial Application

The present invention relates to an improvement in a twin drum type continuous casting apparatus and a continuous casting method in which a change in shape caused by a thermal load of water-cooling drums is controlled.

2. Description of the Related Art

A conventional twin drum type continuous casting apparatus (Japanese Patent Laid-Open Application No. Hei 2-104449), which is a kind of a thin plate continuous casting apparatus, is shown in FIGS. 9 and 10.

As shown in these drawings, molten steel R is continuously fed to a casting mold portion defined by a pair of water-cooling drums 01 which are rotated in opposite directions as indicated by arrows and a pair of side dams 02, and is cooled by outer circumferential walls of the water-cooling drums 01 to thereby continuously cast a thin plate cast piece W. A water feed port 01*a*, a water discharge port 01*e*, a number of water feed passages 01*b*, a water cooling passage 01*c* along the outer periphery of each water-cooling drum 01 and a water discharge passage 01*d* are provided in an interior of each water-cooling drum 01. Heater blocks 03 are internally provided over an entire circumferential wall of both end portions of each water-cooling drum 01.

In this casting apparatus, when the molten steel R is fed to the casting mold portion, the outer circumferential portion of each water-cooling drum 01 is thermally expanded with both its ends being extended in a width direction of the roll. In accordance with this expansion, the water-cooling drum 01 is shrunk and deformed in the radial direction by $\delta$ as indicated by dotted lines in FIG. 11(*a*). Accordingly, an interval between the two water-cooling drums 01 is further increased by $2\delta$ at both ends beyond the interval in the central portion. Also, a thickness at both end portions of the workpiece to be cast is increased by $2\delta$, resulting in a worse plate shape.

Therefore, cooling water is fed from the water feed port 01*a* to the water cooling passage 01*c*, and at the same time a current is supplied to the heater blocks 03 to heat both end portions of each drum. As a result, as shown by dotted lines in FIG. 11(*b*), the end portions are expanded and deformed by $\delta$ in the radial direction to cancel the thermal deformation caused by the above-described molten steel R to equalize the interval over the entire width of each drum.

In this case, a planar shape detector (not shown) is provided at the outlet of the cast piece W to periodically detect the plate thickness over the entire width of the cast piece W. On the basis of the detection signal, the amount of heat generation of each heater block 03 is adjusted to control the thermal expansion amount at both end portions of each drum and to well control the plate shape of the cast piece W.

As described above, in the conventional continuous casting apparatus, a method is adopted in which both end portions of each drum are heated and expanded by the heater blocks 03 internally provided in both end portions of each drum to thereby perform shape control of the outer surfaces of the water-cooling drum. However, since the thermal capacitance of each drum 01 to be heated is large, a deformation responsibility of the shape of the outer surfaces of the drum to be controlled is low, and it would be difficult or impossible to timely control the workpiece to be continuously cast timely. The conventional apparatus suffers from such a problem.

Also, since the heater blocks 03 are internally provided in each drum 01, the heating with the heater blocks 03 is non-uniform, and it would be impossible to suitably control the shape of the workpiece to be continuously cast.

SUMMARY OF THE INVENTION

In order to solve the problems inherent in a twin drum type continuous casting apparatus for continuously feeding molten metal into a cast portion defined by a pair of water cooling drums that are rotated in opposite directions to each other, thereby continuously casting a plate-like cast piece, according to the present invention, a thin portion is formed close to an outer circumferential portion of each of opposite end portions, in a width direction, of each of the water cooling drums and a thin annular member having a hot water flow passage therein is formed in between the thin portion and a shaft with a space relative to an end face of each of the water cooling drums.

It is possible to impart a gradient so that a wall surface on the outer circumferential side of each drum, which wall surface forms the space, expands toward each end face of the drum.

According to the present invention, in the twin drum type continuous casting apparatus, since the pair of water cooling drums are provided, the thin annular members are immediately heated and expanded when the hot water is supplied to the hot water flow passages of the thin annular members based upon a signal from cast piece planar shape detectors, whereby the thin portions at both ends of the water cooling drums are deformed to thereby suitably control the drum outer diameter.

Since the space is interposed between the thin annular member and the end face of the water cooling drum, the profile of the surface of the water cooling drum is formed by smooth curved lines, and it is possible to control the shape of the cast piece to be flat at its central portion or to be projected at the central portion.

Also, with such a space, it is possible to reduce the thermal stress change caused by the expansion/shrinkage of the thin annular member.

According to the present invention, the apparatus may further comprise a crown calculating means for detecting a distribution of plate thickness of the plate-like cast piece held immediately below the water cooling drums and calculating a cast piece crown, means for calculating a crown difference between a cast crown obtained by the crown calculating means and a predetermined target crown, and means for controlling a temperature of hot water to be supplied to the thin annular member in response to the crown difference.

In the thus constructed twin drum type continuous casting apparatus according to the present invention, the crown of the plate-like cast piece to be cast and the crown difference are periodically calculated, the temperature of the hot water to be supplied to the thin annular member is suitably controlled by these values, and it is therefore possible to manufacture the plate-like piece having a desired shape.

The apparatus may further comprise crown change rate calculating means for calculating a change rate of the cast crown based upon the cast piece crown obtained by the crown calculating means, and means for controlling a flow rate of the hot water to be supplied to the thin annular member based upon the change rate of the cast piece crown.

According to this twin drum type continuous casting apparatus, the crown, the crown difference and the change rate of the plate-like cast piece to be cast are periodically calculated, and the flow rate and the temperature of the hot water to be supplied to the thin annular member are suitably controlled in accordance with these crown difference and crown change rate to thereby manufacture the plate-like cast piece having a desired shape.

In a twin drum type continuous casting apparatus according to the invention, it is preferable to use a method comprising the steps of: periodically detecting a difference in thickness between edge portions and a central portion of the plate-like cast piece to be continuously cast; if the detected value exceeds a range of a control target value, supplying water to the annular member by decreasing the water temperature; and if the detected value is smaller than the range of the control target value, supplying water to the annular member by increasing the water temperature.

In this case, a constant flow rate of the hot water relative to the thin annular member may be used.

Also, according another aspect of the invention, it is preferable to use a twin drum type continuous casting apparatus which uses a method comprising the steps of: periodically detecting a difference in thickness between edge portions and a central portion of the plate-like cast piece to be continuously cast; if a change rate of the detected value exceeds a standard range, supplying water to the annular member by increasing the flow rate of the water; and if a change rate of the detected value is smaller than the standard range, supplying water to the annular member by decreasing the flow rate of the water.

Also, in the twin drum type continuous casting apparatus according to the present invention, in addition to the feature that each water cooling drum is formed as described above, it is preferable that partition plates are provided for dividing the hot water flow passage of the thin annular member into a plurality of sections in a circumferential direction and a feed port and a discharge port for hot water which are in fluid communication with each of the sections are formed in each of the sections.

These partition plates are preferably arranged so as to symmetrically divide the hot water flow passage in the thin annular member into a plurality of sections in the circumferential direction.

With the twin drum type continuous casting apparatus thus constructed, since the hot water is simultaneously fed and discharged into the plurality of divided hot water flow passages of the thin annular member, the shaft and the annular member are uniformly thermally expanded in the circumferential direction, whereby the thin portion of each end portion of the water cooling drum is also uniformly deformed in the circumferential direction to thereby perform a more preferable shape control.

The controlled state is shown in FIG. 6. The start of the control is effected immediately after the state where the cast piece crown is out of the non-sensitive region has been detected.

According to the conventional method, since the compensation rate of the cast piece crown is slow, the cast piece crown value is changed largely away from a non-sensitive band set range. Thus, it takes a long period of time to obtain a desired cast piece. However, according to the present invention, since the compensation rate is high, it is possible to immediately correct the cast piece to the non-sensitive set range.

Furthermore, in the twin drum type continuous casting apparatus according to the present invention, in addition to the feature that each water cooling drum is constructed as described above, an initial crown may be formed on an outer circumferential surface of the water cooling drum. Since the compensation deformation of the water cooling drum caused by the thin annular member may be reduced so that the maintenance of the cast piece shape may readily be performed by a small temperature change by the hot water.

It is therefore possible to reduce a load to be imposed on the water cooling drum and the thin annular member and the durability of the apparatus may be remarkably enhanced.

BRIEF DESCRIPTION OF THE DRAWINGS

In the accompanying drawings:

FIG. 11(*a*) is an illustration of a thermal deformation of a water cooling drum in a twin drum type continuous casting apparatus where the thermal deformation has been generated, and FIG. 11(*b*) is an illustration of the thermal deformation of the water cooling drum in the twin drum type continuous casting apparatus where the thermal deformation has been compensated for.

DESCRIPTION OF THE PREFERRED EMBODIMENTS

An apparatus according to each embodiment of the invention will now be described by way of example with reference to the accompanying drawings.

(First Embodiment)

Figure 3:
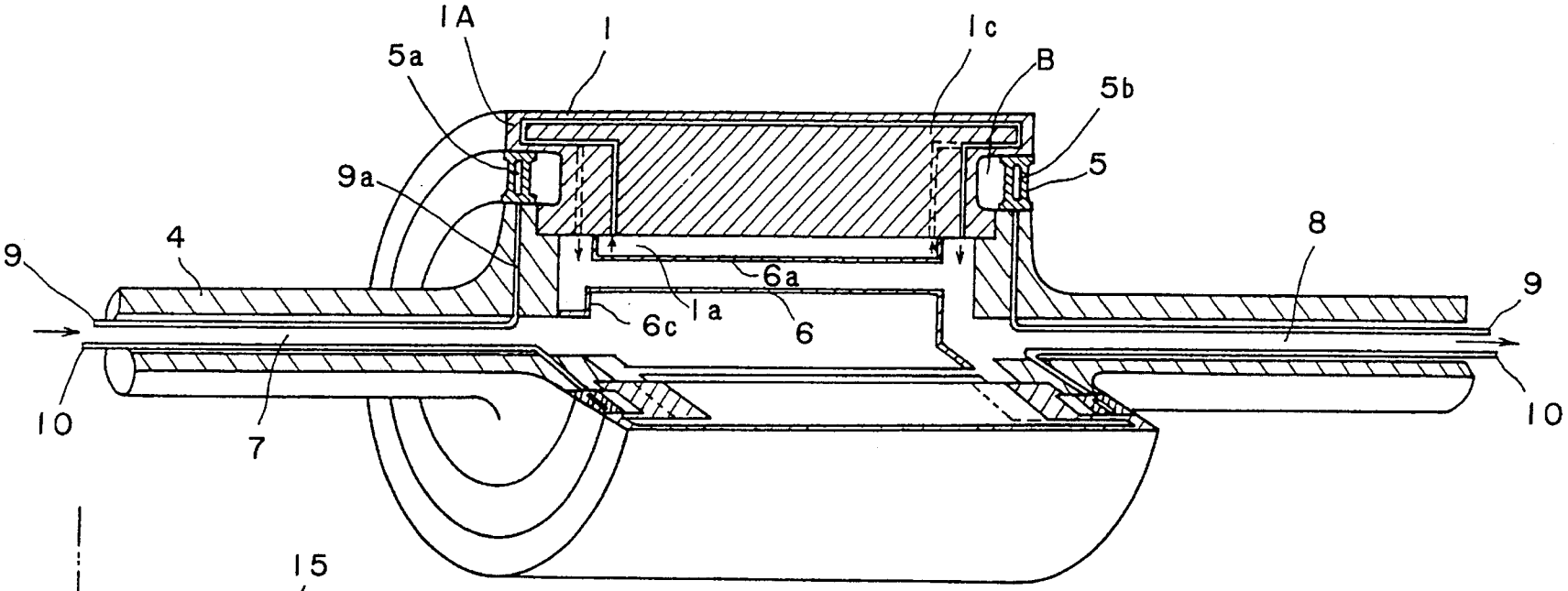
FIG. 3 is a partially fragmentary perspective view showing the water cooling drum shown in FIG. 1.
Figure 4:
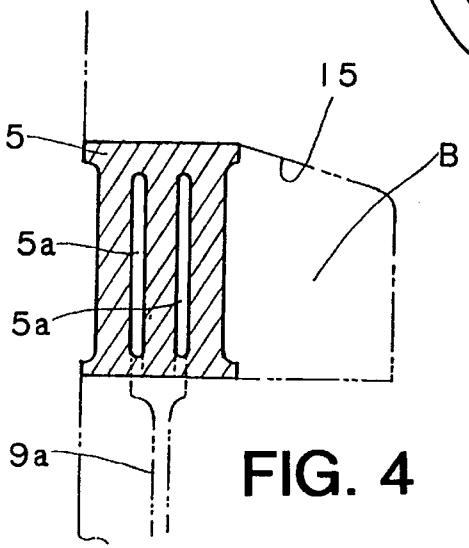
FIG. 4 is a cross-sectional view showing an example in which a hot water flow passage is divided into a plurality of sections (rows) in the thin annular member.
Figure 5:
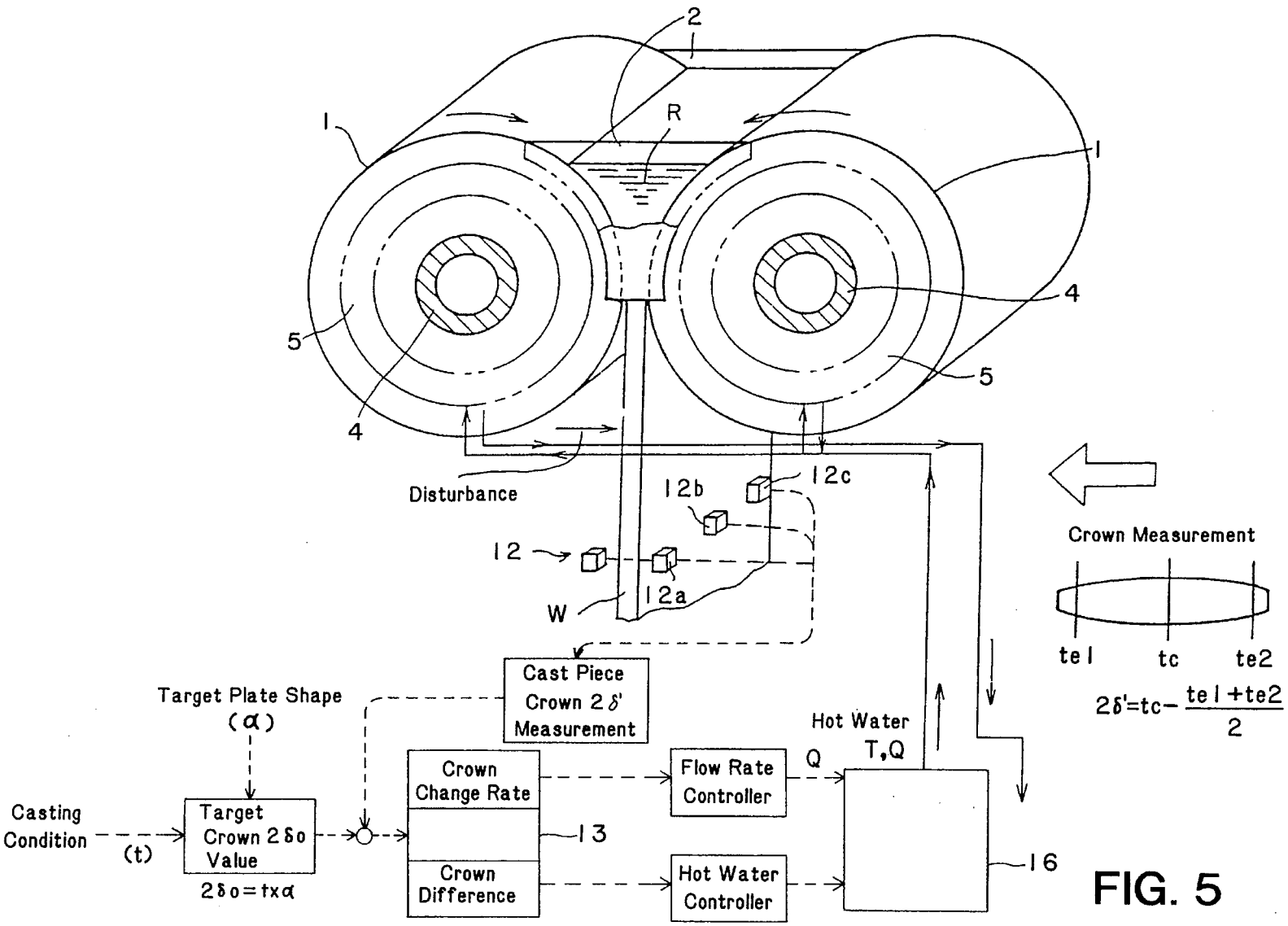
FIG. 5 is a schematic view showing shape control of the water cooling drum of the twin drum type continuous casting apparatus shown in FIG. 1.

FIGS. 1 through 5 show a primary part of a twin drum type continuous casting apparatus according to one embodiment of the invention. In the apparatus, molten steel R is fed to a casting portion defined by a pair of water-cooling drums 1 which are rotated in opposite directions as shown in FIG. 5 and a pair of side dams 2, and is cooled down and solidified by the outer surfaces of the water-cooling drums 1 to continuously cast a thin plate cast piece W.

Plate shape detectors 12 (12*a*, 12*b*, 12*c*) each of which is composed of a radioactive ray thickness meter are disposed at an outlet of the apparatus for detecting thicknesses at three or more points, for example a central point and both edges, to thereby control the profile shape of the outer surfaces of the water-cooling drums 1 on the basis of the signals detected periodically and to thereby perform the shape control of the cast piece W.

The difference $2\times\delta'$ in thickness between the central portion and both edges of the planar cast piece W, i.e. the cast piece crown measured periodically by the plate shape detectors 12, is compared with a target crown value $2\times\delta_0$, and the difference $\Delta\delta$ therebetween is fed to a controller 13.

The controller 13 controls a hot water feeder 16 in response to the crown difference $\Delta\delta=(2\delta'-2\delta_0)/2$ and the crown change rate $\Delta\delta/\Delta t=(2\delta'-2\delta_0)/\Delta t$ to thereby adjust the temperature T and the flow rate Q of the hot water to be supplied to thin annular members 5 provided in the water-cooling drums 1.

Incidentally, the target crown value $2\times\delta_0$ is determined by the drum initial crown value, the drum shape change value, the thickness t of the planar cast piece and the target plate shape $\alpha$.

Figure 1:
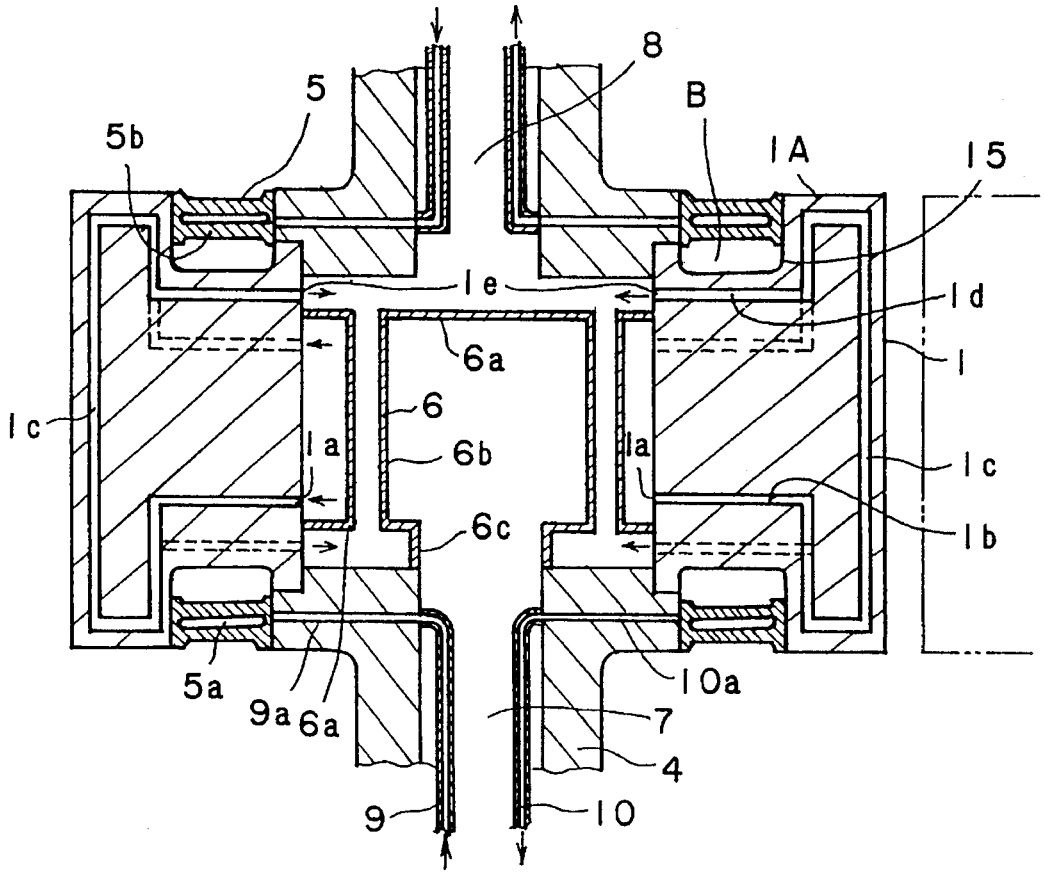
FIG. 1 is a cross-sectional view showing a primary part of a twin drum type continuous casting apparatus according to one embodiment of the invention.
Figure 2:
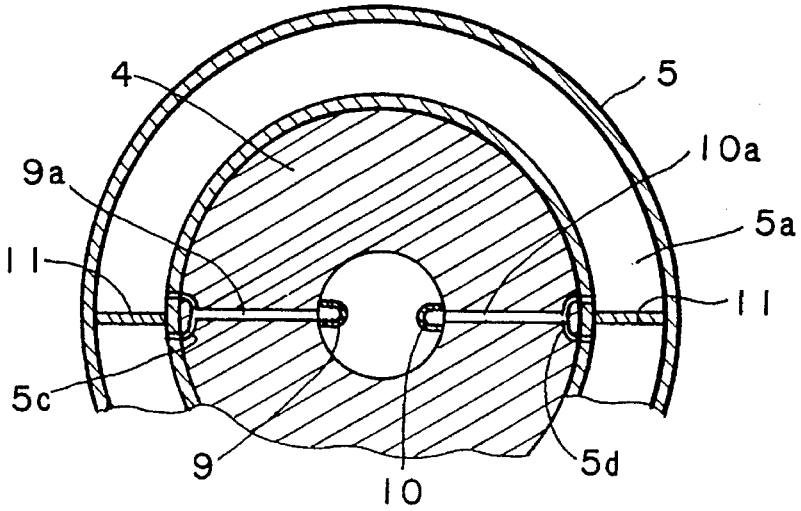
FIG. 2 is a cross-sectional view showing a hot water flow passage of a water cooling drum shown in FIG. 1.

As shown in FIGS. 1 to 3, a diameter of each water-cooling drum 1 is set at 1,200 mm and a width thereof is set at 1,330 mm, and thin portions 1A having gradients 15, with a central side thickness of 120 mm and with both end portions of 100 mm, is formed at both end portions of the drum. A water feed passage 1*b*, a water discharge passage 1*d* and a water cooling passage 1*c* along the outer circumferential surface are formed within each water cooling drum 1. The cooling water is fed from a cooling water feed pipe 7 through a water feed port 1*a* and the water feed passage 1*b* to the water cooling passage 1*c* to thereby cool the outer circumferential surface of each drum 1, and the water is discharged through a water discharge passage 1*d* and a water discharge port 1*e* from a cooling water discharge pipe 8.

Incidentally, partition parts 6*a*, 6*b* and 6*c* constitute a partitioning wall 6 for partitioning the flow-in chamber and discharge chamber of the cooling water in each water-cooling drum 1.

An annular member 5 in which a hot water flow passage 5*a* having a gap of 5 mm is formed is inserted in a space B defined between the shaft 4 and the above-described thin portion 1A. The annular member has a post portion 5*b* having a thickness of 20 mm. A space is formed at an interval of 60 mm in the axial direction of each drum 1 between the annular member 5 and the drum end face within the space B.

The hot water is supplied from the hot water feed pipe 9 through a water passage 9*a* to the hot water passage 5*a* in the annular member 5 to thereby thermally expand the latter and is discharged from the hot water discharge pipe 10 through the water discharge passage 10*a*.

FIG. 2 is a view showing a fluid communication passage for the hot water. The hot water flow passage 5*a* is divided in the circumferential direction into two sections by partition plates 11. The hot water fed from the hot water feed pipe 9 is caused to uniformly flow into the respective divided grooves from the respective feed ports 5*c* through the water feed passages 9*a* and to be discharged from the respective discharge ports 5*d* through the water discharge passages 10*a* to the hot water discharge pipes 10.

In the embodiment shown, the hot water flow passage 5*a* is divided into two sections by the partition plates 11. The divisional manner of the hot water flow passage 5*a* with the partition plates 11 may be adopted suitably in order to uniformly heat the annular member by dividing it into a further plural number of sections in the circumferential direction as desired.

Also, as shown in FIG. 4, the hot water flow passage 5*a* may be formed into a plurality of rows in the annular member 5.

Figure 11A:
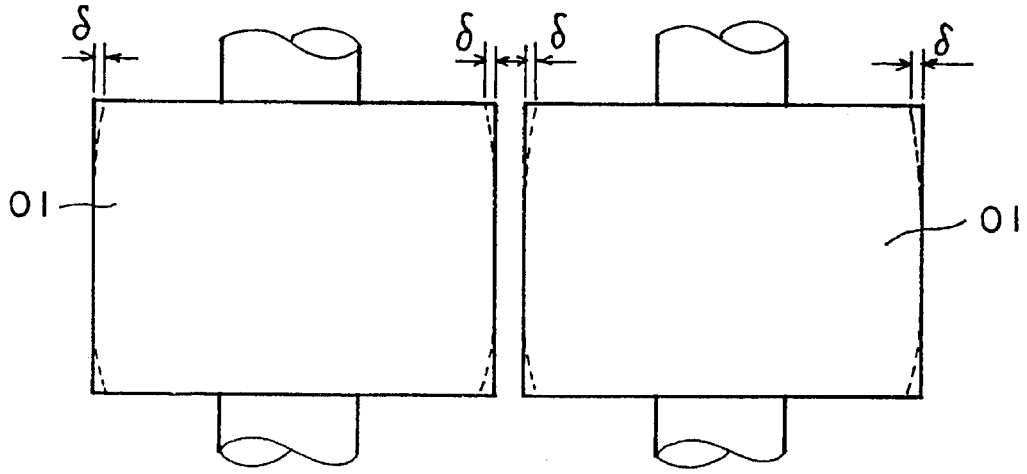
FIG. 11(a) (PRIOR ART)
Figure 11B:
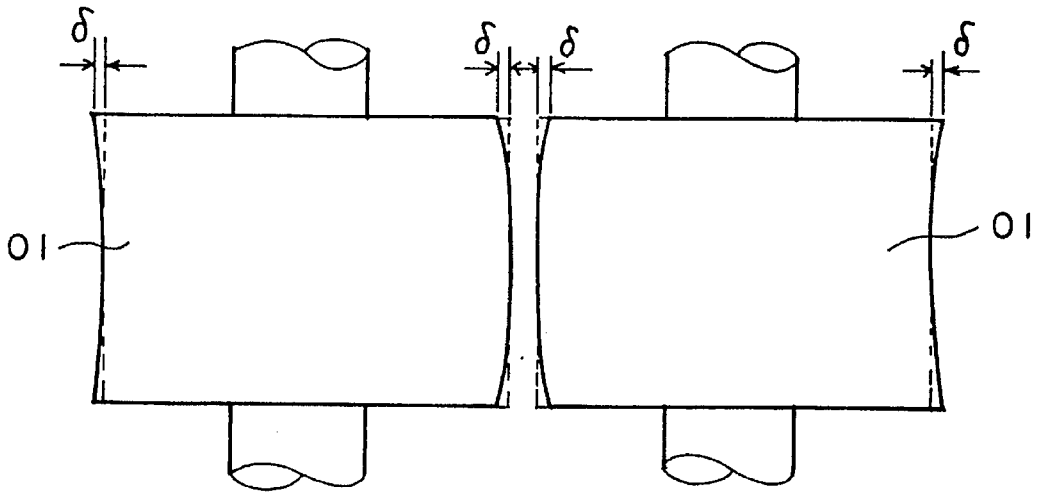
FIG. 11(b) (PRIOR ART)

The operation of the apparatus in accordance with the embodiment will now be described.

when the molten steel R is fed into the above-described casting portion defined by the pair of water-cooling drums 1 and side dams 2 to continuously cast a thin strip cast piece W, the casting portions of the pair of water-cooling drums 1 are subjected to thermal loads and deformed as described above (see FIG. 11(*a*)). As a result, the thickness of the opposite edge portions of the thin plate cast piece W is increased to $2\times\delta$ at maximum (i.e., about 30% of the entire width), resulting in a degradation of the plate thickness shape.

Therefore, in the apparatus according to the invention, the cooling water is supplied from the cooling water feed pipes 7 to thereby cool the outer circumferential surface of each cooling water drum 1, and the maximum plate thickness difference $2\times\delta'$ between the edge portions and the central portion of the plate of the cast piece W which is continuously cast is periodically detected by the plate shape detectors 12 (FIG. 5). The difference between the target crown value $2\delta_0$ and the detected value is fed to the controller 13. If the detected crown value $2\delta'$ falls within the control target range, the temperature and the flow rate of the hot water to be supplied from the hot water feeder 16 to the annular member 5 is kept unchanged.

If the detected crown value $2\delta'$ of the planar cast piece W exceeds the target crown value $2\delta_0$, the water temperature drop rate and the flow rate are set based upon the relationship between the drum shape change rate and the water temperature difference between the drum cooling water, which is measured in advance, and the hot water. The hot water is fed to the annular member 5.

On the other hand, if the detected crown value $2\delta'$ is smaller than the target crown value $2\delta_0$, the water temperature increase rate and the flow rate are set in the same manner. The cooling water is fed to the annular member 5.

The magnitude of the crown change rate $\Delta\delta=(2\delta'-2\delta_0)/2$ is determined by setting the temperature of the hot water, but the crown change rate $\Delta\delta/\Delta t=(\delta'_1-\delta'_{i-1})/\Delta t$ may be rapidly adjusted within the target crown value or may be gradually adjusted within the target crown value by detecting changes in case crown amount on a time basis for several seconds and increasing/decreasing the water flow rate.

As described above, the flow rate of the hot water to be supplied to the hot water flow passage 5*a* of the annular member 5, the water temperature and the like are set and controlled based on the relationship between the predetermined water temperature difference and the drum change amount.

Thus, the annular member 5 is thermally expanded to deform the edge portions of each water cooling drum 1 in the radial direction by $\delta$. Since the space B is provided in each water cooling drum 1 and at the same time, the thickness of the thin portion 1A thereof is small at 120 mm, the outer circumferential surface of each drum is deformed along a smooth curve. Thus, the deformation $\delta$ of edge portions of the water cooling drum 1 caused by the molten steel R is canceled, and the interval of the casting portion is somewhat increased at the central portion so that a thin planar cast piece W having a good plate shape may be continuously cast.

In this case, since the thickness of the post portion 5*b* of the annular member 5 is small at 20 mm, the thermal responsiveness caused by the hot water which is flowing through the hot water flow passage 5*a* is good. Also, since the opposite end portions of the water cooling drum 1 are thin, the deformation responsiveness caused by the thermal expansion deformation of the annular member 5 is good. Accordingly, δ is changed at a deformation rate of about 2 μm/sec in an on-line manner in accordance with the control signal of the controller 13, which signal is periodically fed. As a result, it is possible to perform shape control of the profile of the cast piece in a good manner.

Also, since the hot water flow passage 5*a* of the annular member is divided circumferentially into two sections by the partition plate 11, the hot water is simultaneously fed into the divided sections and the annular member 5 is uniformly expanded in the circumferential direction. As a result, both the end portions of the drum 1 is uniformly deformed, and hence it is possible to perform a shape control of a profile of the cast piece in a good manner.

Figure 6:
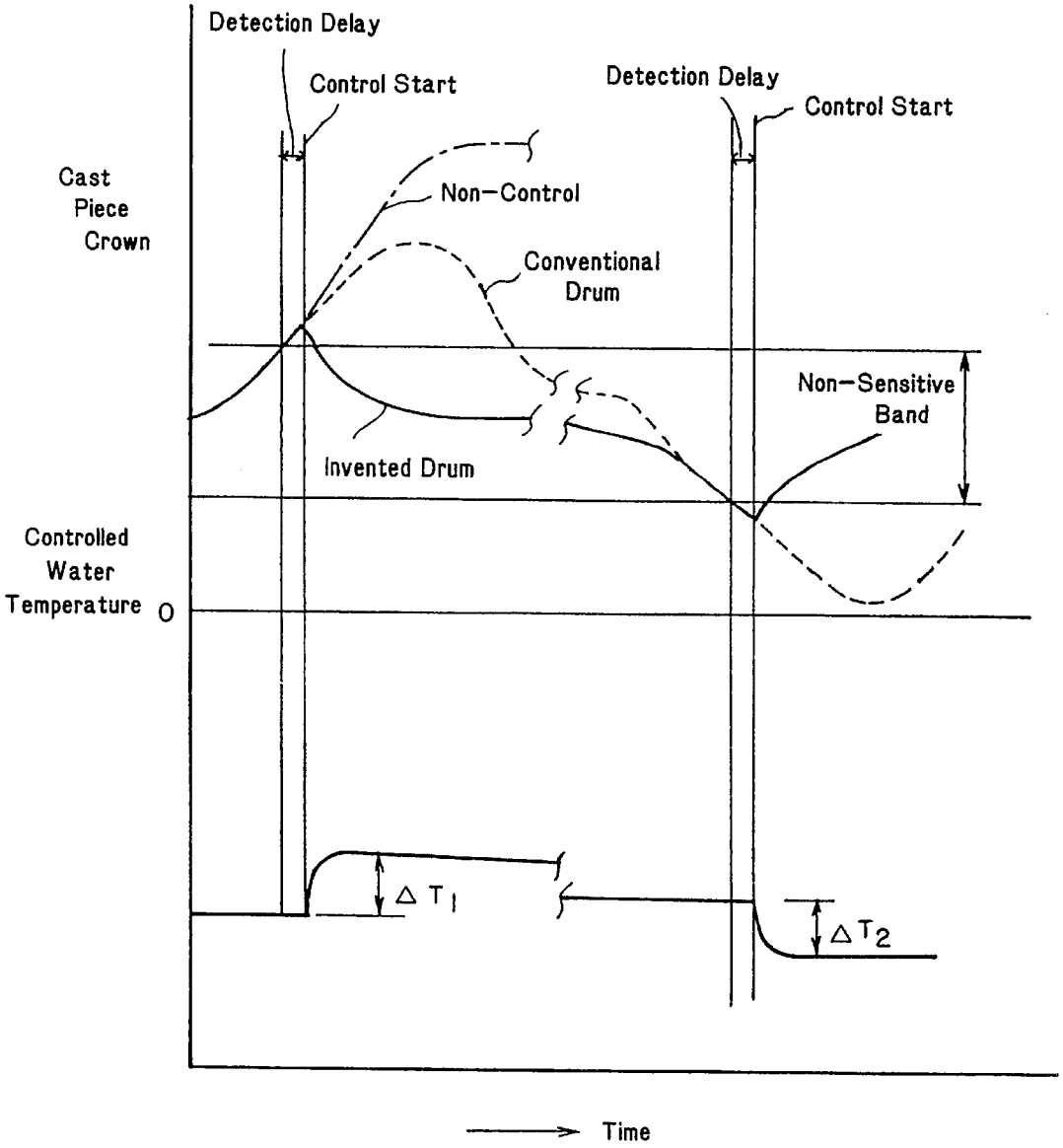
FIG. 6 is an illustration of a time basis change of the shape control of the water cooling drum in the twin drum type continuous casting apparatus shown in FIG. 1.

The shape control of the water cooling drum in accordance with the first embodiment may be rapidly performed as explained in conjunction with FIG. 6.

Figure 7:
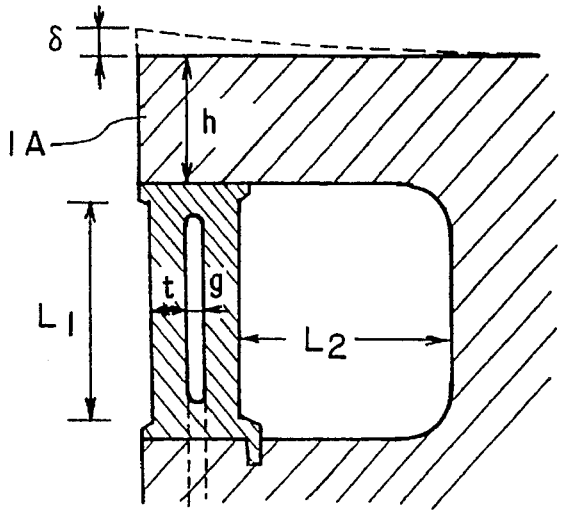
FIG. 7 is a partially sectional view showing the dimension of the water cooling drum and the thin annular member.

(Second Embodiment) In a twin drum type continuous casting apparatus constructed in the same manner as in the first embodiment, the diameter of the water cooling drum is set at 1,200 mm, and the width, at 1,330 mm. A dimension of each component of the water cooling drum and the thin annular member shown in FIG. 7 is selected as indicated in Table 1. Then the effect of the invention was confirmed. According to the invention, since the compensation rate after the start of the compensation control for the water cooling drums was high, the cast piece crown was rapidly returned back to a regular level.

Also, in any one of the examples 1–8, effective compensation amounts δ' were obtained and the flat cast piece shape or the shape where the central portion was somewhat projected was obtained.

outer surface of the drum are the same as those of the first embodiment.

When the casting is started by using the water cooling drums 1 with the initial machined crown 1X, the casting portion of the water cooling drums 1 are subjected to the thermal load and deform so that the edge portions of the cast piece W are deformed to increase the thickness up to about 2δ. However, since the initial crown 1X is formed to meet the value that is somewhat smaller than δ, the compensation deformation caused by the thin annular members 5 may be made small. In other words, since it is possible to obtain a desired cast piece crown with a small temperature change ΔT due to the hot water, the load to be imposed on the water cooling drums 1 and the thin annular members 5 may be small, and the durability is considerably enhanced.

As described above in detail, in the twin drum type continuous casting apparatus and the method therefor according to the present invention, the thin portions are formed close to the outer circumferential portions at the opposite end portions in the width direction of each water cooling drum; the thin annular members each having the hot water flow passage therein are formed in between the thin portions and the shaft; the crown value of the cast piece to be continuously cast is periodically detected; the flow rate of the hot water to be supplied to the hot water flow passage within the thin annular members, the water temperature and the like are controlled in response to the signal; and the space is formed between each drum sleeve and the thin annular member is formed. Accordingly, the shape of the end portions of each water cooling drum is smoothly corrected and controlled so that the shape of the casting portion is made parallel or the interval of the central portion thereof is somewhat increased. As a result, it is possible to continuously cast the thin plate cast piece having a good plate shape.

Also, the fluid that flows through the hot water flow passage in each thin annular member is hot or cool water, and the annular member is of the thin type. Accordingly, a period of time for the heat transmission to the annular member is shortened, and it is possible to compensate for the shape of the cast piece crown in an on-line manner for a control period, i.e., several seconds.

TABLE 1

| Ex. | t (mm) | g (mm) | $L_1$ (mm) | h (mm) | $L_2$ (mm) | compensation amounts δ (μm) | compensation rate (μm/sec) | note |
|---|---|---|---|---|---|---|---|---|
| 1 | 5 | 6 | 100 | 80 | 50 | 50 | 10 | invention |
| 2 | 8 | 5 | 100 | 100 | 60 | 90 | 8 | " |
| 3 | 20 | 5 | 100 | 100 | 60 | 120 | 2 | " |
| 4 | 25 | 5 | 100 | 100 | 60 | 130 | 1.5 | " |
| 5 | 40 | 5 | 100 | 100 | 60 | 140 | 0.8 | " |
| 6 | 30 | 5 | 100 | 100 | 60 | 135 | 1.0 | " |
| 7 | 15 | 6 | 80 | 90 | 50 | 80 | 2.8 | " |
| 8 | 25 | 6 | 100 | 100 | 60 | 110 | 1.5 | " |
| 9 | — | — | 100 | 100 | — | 30 | 0.1 | prior art |

(Third Embodiment)

Figure 8:
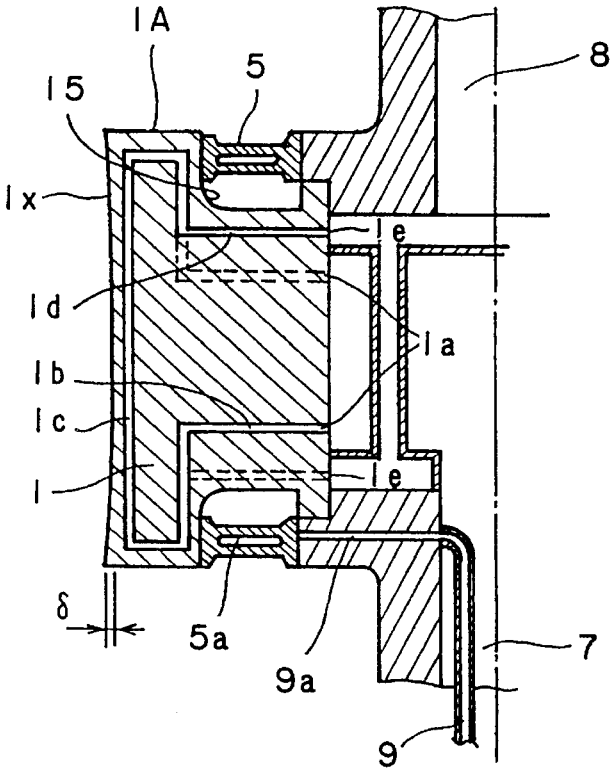
FIG. 8 is a partially sectional view showing a water cooling drum provided with an initial crown.
Figure 9:
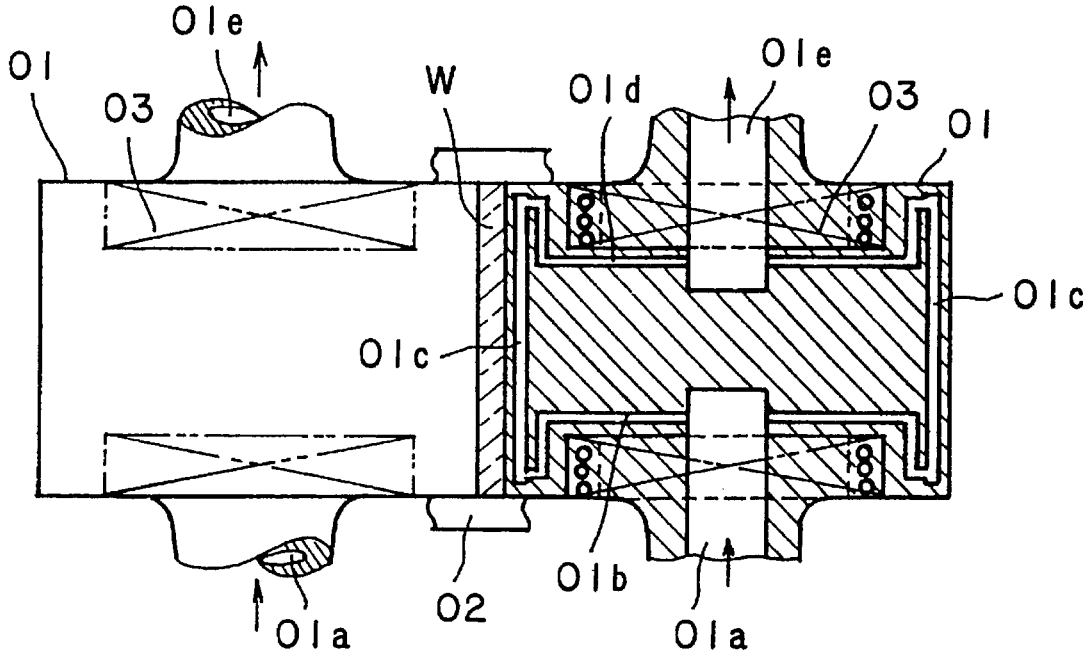
FIG. 9 (PRIOR ART)
FIG. 9 is a plan and partially sectional view showing a conventional twin drum type continuous casting apparatus.
Figure 10:
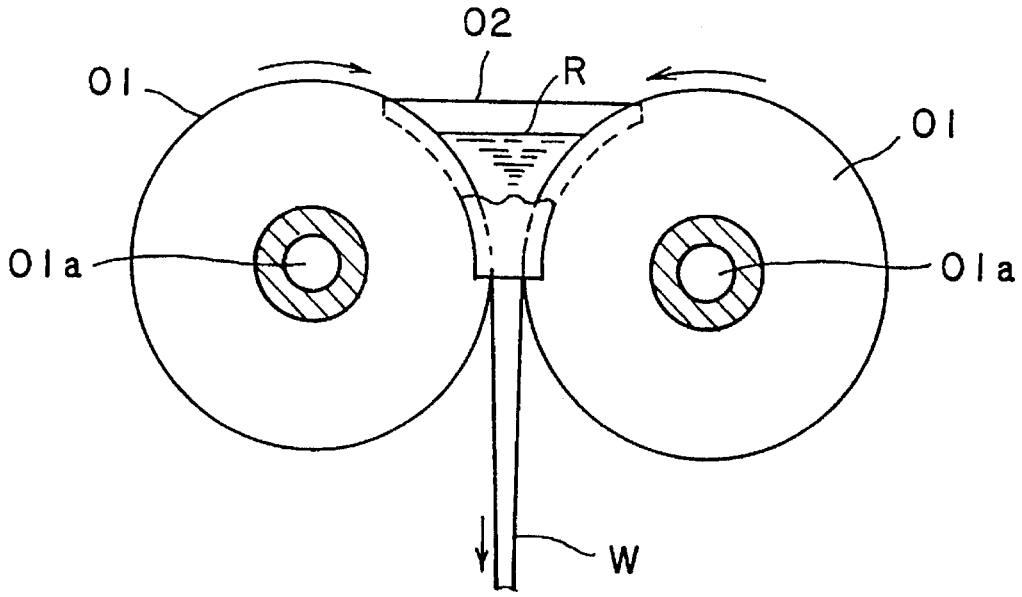
FIG. 10 (PRIOR ART)
FIG. 10 is a side elevational view showing the apparatus shown in FIG. 9.

As shown in FIG. 8, an initial crown 1X is machined or worked on each water cooling drum prior to the casting work. Thereafter, the casting is carried out. Thus, it is possible to carry out the casting work for obtaining a precise cast piece shape by reducing temperature changes of the hot water, i.e. the load to be imposed on the drum sleeve and the thin annular member. In the third embodiment, the features other than that of the provision of the initial crown 1X on the Further, by adopting the structure in which the hot water flow passage in the annular member is divided into a plurality of sections in the circumferential direction, the hot water is supplied simultaneously to the divided sections to thereby deform the end portions of each water cooling drum uniformly in the circumferential direction in accordance with the thermal expansion of the annular member whereby the shape control of the cast piece may be effected well.

Furthermore, if the initial crown is formed on the outer circumferential surface of the water cooling drum, it is possible to compensate for the shape of the drum with a low temperature control.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A twin drum type continuous casting apparatus for continuously feeding molten metal into a cast portion defined by a pair of water cooling drums that are rotated in opposite directions to each other, thereby continuously casting a plate-like cast piece, characterized in that a thin portion is formed close to an outer circumferential portion of each of opposite end portions, in a width direction, of each of said water cooling drums; and a thin annular member having a hot water flow passage therein is formed in between said thin portion and a shaft of each of said water cooling drum with a space between an inner annular surface of each said thin annular member and end face of a respective one of said cooling drums.

2. The apparatus according to claim 1, wherein partition plates are provided for dividing said hot water flow passage of said thin annular member into a plurality of sections in a circumferential direction; and a feed port and a discharge port for hot water which are in fluid communication with each of said sections are formed in each of said sections.

3. The apparatus according to claim 1, wherein an initial crown is formed in an outer circumferential surface of each of said water cooling drums.

4. The apparatus according to claim 1, further comprising crown calculating means for detecting a distribution of plate thickness of the plate-like cast piece immediately below said water cooling drums and calculating a cast piece crown, means for calculating a crown difference between the cast crown obtained by said crown calculating means and a predetermined target crown, and means for controlling a temperature of hot water to be supplied to said thin annular member in response to said crown difference.

5. The apparatus according to claim 4, further comprising crown change rate calculating means for calculating a change rate of the cast crown based upon the cast piece crown obtained by said crown calculating means, and means for controlling a flow rate of the hot water to be supplied to said thin annular member based upon the change rate of said cast piece crown.

6. The apparatus according to claim 2, wherein an initial crown is formed in an outer circumferential surface of each of said water cooling drums.

7. A twin drum type continuous casting method for continuously feeding molten metal into a cast portion defined by a pair of water cooling drums that are rotated in opposite directions to each other, thereby continuously casting a plate-like cast piece, by using each drum in which a thin portion is formed close to an outer circumferential portion of each of opposite end portions, in a width direction, of each of said water cooling drums, and a thin annular member having a hot water flow passage therein is formed in between said thin portion and a shaft of each of said water cooling drum with a space between an inner annular surface of each said thin annular member and end face of a respective one of said cooling drums said method comprising the following steps of:

periodically detecting a difference in thickness between edge portions and a central portion of said plate-like cast piece to be continuously cast;

if the detected value exceeds a range of a control target value, supplying water to said annular member by decreasing a water temperature; and if the detected value is smaller than the range of the control target value, supplying water to said annular member by increasing the water temperature.

8. The method according to claim 6, wherein if a change rate of the detected value exceeds a standard range, supplying water to said annular member by increasing the flow rate of the water and if a change rate of the detected value is smaller than the standard range, supplying water to said annular member by decreasing the flow rate of the water.

9. A twin drum type continuous casting method for continuously feeding molten metal into a cast portion defined by a pair of water cooling drums that are rotated in opposite directions to each other, thereby continuously casting a plate-like cast piece, by using each drum in which a thin portion is formed close to an outer circumferential portion of each of opposite end portions, in a width direction, of each of said water cooling drums, and a thin annular member having a hot water flow passage therein is formed in between said thin portion and a shaft of each of said water cooling drum with a space between an inner annular surface of each said thin annular member and end face of a respective one of said cooling drums said method comprising the following steps of:

periodically detecting a difference in thickness between edge portions and a central portion of said plate-like cast piece to be continuously cast;

if a change rate of the detected value exceeds a standard range, supplying water to said annular member by increasing the flow rate of the water; and if a change rate of the detected value is smaller than the standard range, supplying water to said annular member by decreasing the flow rate of the water.

* * * * *